US008832984B1

(12) United States Patent
Vesligaj

(10) Patent No.: US 8,832,984 B1
(45) Date of Patent: Sep. 16, 2014

(54) RECOIL REDUCTION FIREARM STOCK ASSEMBLY

(71) Applicant: Zeljko Vesligaj, Burgaw, NC (US)

(72) Inventor: Zeljko Vesligaj, Burgaw, NC (US)

( * ) Notice: Subject to any disclaimer, the term of this patent is extended or adjusted under 35 U.S.C. 154(b) by 0 days.

(21) Appl. No.: 13/788,679

(22) Filed: Mar. 7, 2013

(51) Int. Cl.
*F41C 23/00* (2006.01)

(52) U.S. Cl.
USPC ..... 42/74; 42/75.03

(58) Field of Classification Search
USPC ..... 42/1.06, 71.01, 72, 73, 74, 75.01, 75.03
See application file for complete search history.

(56) References Cited

U.S. PATENT DOCUMENTS

| | | | | |
|---|---|---|---|---|
| 724,273 | A * | 3/1903 | Ermel | 42/74 |
| 910,276 | A * | 1/1909 | Easdale | 42/74 |
| 1,412,017 | A * | 4/1922 | Johnson | 42/105 |
| 1,583,616 | A * | 5/1926 | Smith | 42/75.03 |
| 2,455,438 | A * | 12/1948 | Oppold | 42/74 |
| 3,039,222 | A | 6/1959 | Hoge | |
| 3,176,424 | A | 4/1965 | Hoge | |
| 7,124,529 | B1 * | 10/2006 | Havelka, Jr. | 42/74 |
| 7,386,952 | B1 * | 6/2008 | Henretty | 42/71.01 |
| 7,647,709 | B2 * | 1/2010 | Reilly et al. | 36/30 R |
| 8,176,668 | B2 * | 5/2012 | Simms et al. | 42/1.06 |
| 2003/0140542 | A1 * | 7/2003 | Kay | 42/75.03 |
| 2004/0031182 | A1 * | 2/2004 | Bentley | 42/74 |
| 2008/0110074 | A1 * | 5/2008 | Bucholtz et al. | 42/1.06 |
| 2012/0042556 | A1 * | 2/2012 | Vesligaj | 42/75.03 |
| 2012/0260552 | A1 * | 10/2012 | Vesligaj | 42/1.06 |

* cited by examiner

*Primary Examiner* — Gabriel Klein
(74) *Attorney, Agent, or Firm* — MacCord Mason PLLC

(57) ABSTRACT

A recoil reduction stock assembly for a shoulder-fired firearm is described that includes a rear stock section housing a recoil reduction mechanism attachable to firearms with different receiver rear faces by using a front stock section having a rear face attachable to the rear stock section front face and a front face attachable to the rear face of the receiver. The assembly may include one rear stock section housing the recoil reduction mechanism and a plurality of front stock sections, each front stock section having the same rear face profile, but different front face profiles conforming to different receiver rear faces. The recoil reduction mechanism includes a compressible spring and a plunger, whereby recoil of said firearm compresses the spring against the plunger to absorb recoil. The assembly may also include a cheek rest slidably attached over a part of the rear stock section and attached to the recoil mechanism.

16 Claims, 3 Drawing Sheets

RECOIL REDUCTION FIREARM STOCK ASSEMBLY

BACKGROUND OF THE INVENTION (1) Field of the Invention

The present invention relates to an improved recoil reduction stock assembly for use with a shoulder-fired firearm, such as a rifle or a shotgun, and to an improved stock assembly that is adaptable for use with different firearm receivers.

(2) Description of the Prior Art

Shoulder-fired firearms, especially shotguns, may have significant recoil or "kick" due to the rearward force exerted when the firearm is fired. This recoil can decrease accuracy since the shooter may tend to flinch in anticipation of the recoil. In addition, the recoil may cause bruising and discomfort, or more permanent injury of the shooter's shoulder.

As a result, numerous designs have been proposed in the prior art directed to reducing the recoil or the impact of the recoil against the shooter's shoulder. Generally, the solutions proposed involve the installation behind the firearm receiver, e.g., in or behind the stock, of a cylinder that includes a spring or a compressible fluid. Upon firing, the rearward movement of the firearm receiver temporarily compressing the spring or fluid, absorbing a portion of the recoil shock.

Many of the solutions proposed are complex, requiring extensive assembly and difficulty in attachment to the firearm receiver. Other proposed solutions create the potential to pinch the shooter's hand or cheek when fired. Other configurations increase the weight of the firearm or have a shape that is so dissimilar to the usual shape of a firearm stock that it interferes with the normal handling and firing of the firearm. Finally, the configurations of the mechanisms limit their use to a single model of firearm, requiring a different device to be constructed for each firearm model.

Thus, there is a continuing need for a recoil reduction stock that is attachable to different types of firearm receivers, enabling the use of one recoil reduction mechanism with different firearms. In addition, there is a need for a recoil reduction stock for use on firearms that will significantly reduce the shock of recoil while avoiding the risk of pinching the shooter.

SUMMARY OF THE INVENTION

The present invention relates to an improved recoil reduction stock assembly for use on a firearm, especially a shotgun, and to a firearm incorporating the improved stock.

Generally, the recoil reduction stock assembly includes a stock with rear and front sections. The rear stock section has a rear-opening recoil reduction mechanism cavity, and a front face adapted for attachment to the front stock section rear face. The front stock section has a rear face and a front face adapted for attachment to the rear face of a given firearm receiver.

A stock section connector attaches the front and rear stock sections, while a receiver connector attaches the front stock section to a firearm receiver. A recoil reduction mechanism is inserted into the rear stock section cavity. The rear stock section may be combined with different front stock sections, with the front stock sections having the same rear face configuration, but different front face configurations so they can be attached to the rear faces of receivers of different designs. The assembly may also include a cheek rest that fits over a portion of the stock rear section and is attached to the recoil mechanism.

The recoil reduction mechanism is comprised of a housing sized for insertion into the cavity of the stock rear section. The housing includes a generally horizontal, longitudinally aligned cylindrical conduit that holds a compressible spring. Forward movement of the spring within the conduit is limited by a closed conduit front end, which may be effected by a plug in the front end of the conduit. A plunger or piston extends into the rear of the conduit and into engagement with the rear end of the spring. Rearward movement of the plunger is limited by a pin that extends transversely through a longitudinal slot in the wall of the cylinder and into the plunger. Upon rearward movement of the plunger, the pin contacts the rear of the slot, preventing further rearward movement.

The rear end of the plunger is attached to a pressure plate, which preferably has a surface area corresponding to the area of the back of the stock rear section. The plate is in a plane transverse to the axis of the plunger. When the recoil mechanism is in the non-recoil position, the pressure plate is spaced from the rear of the stock.

The cheek rest includes a rear connector plate that is releasibly attached to the recoil mechanism pressure plate, and a cheek plate that extends over at least part of at least one side of the rear stock section, in particular over the area against which the shooter's cheek would normally rest when firing the shotgun. A resilient butt plate is normally attached to the rear of the connector plate.

The recoil mechanism may also include an alignment guide to avoid binding of the plunger within the conduit. The guide may include a projection on the plunger or housing and a receiving slot on the other member, whereby the projection slides within the slot as the plunger moves inwardly and outwardly in the conduit.

DETAILED DESCRIPTION OF THE INVENTION

Figure 1:
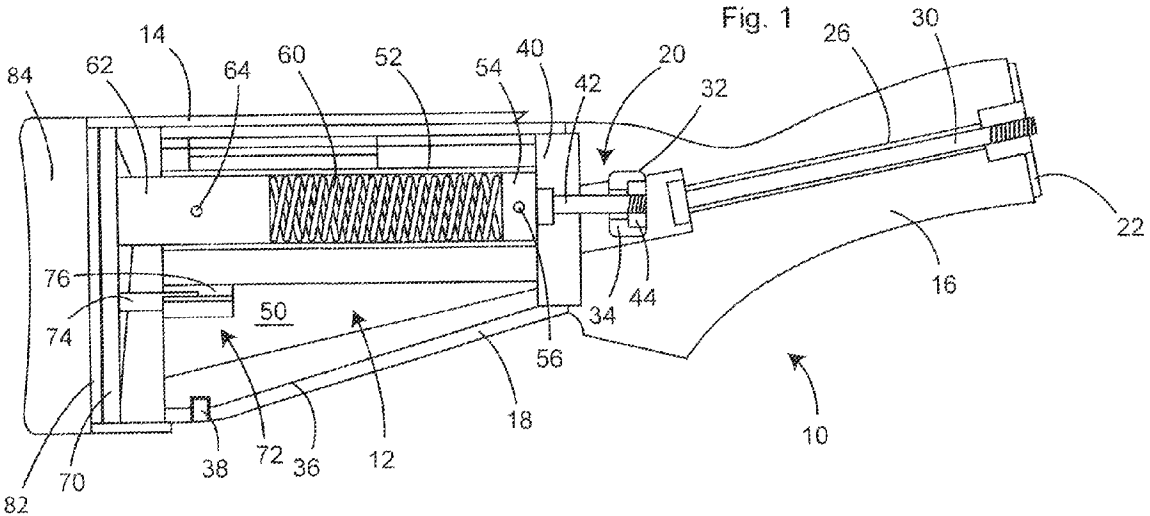
FIG. 1 is a sectional side view of the stock assembly in the non-recoil position.
Figure 2:
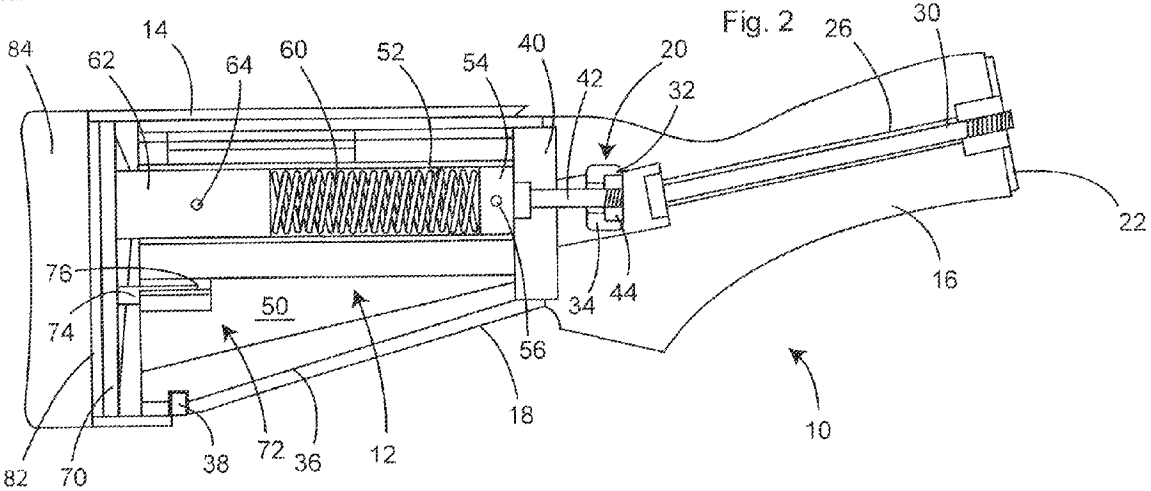
FIG. 2 is a sectional side view of the stock assembly in the recoil position.
Figure 3:
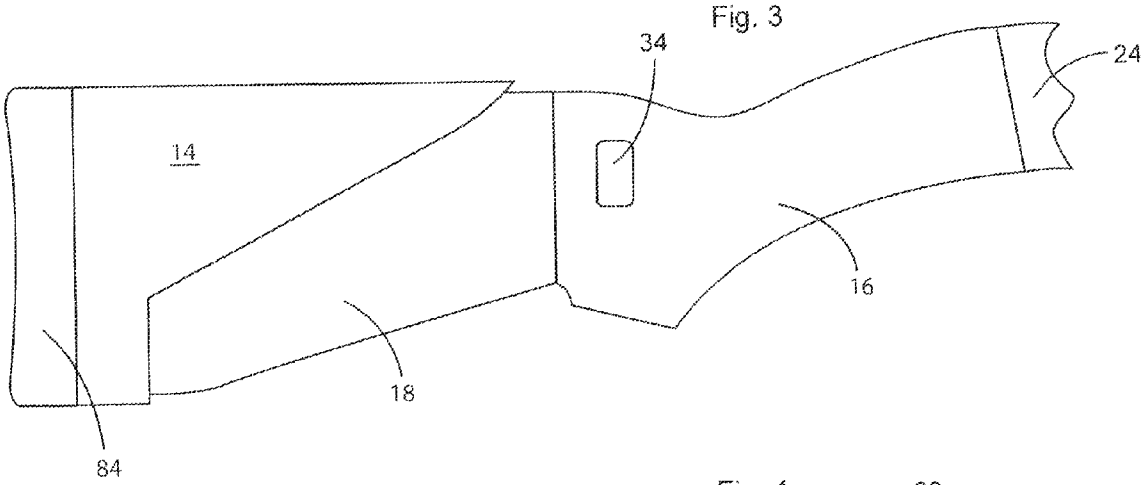
FIG. 3 is a side view of the stock assembly attached to a firearm receiver.
Figure 4:
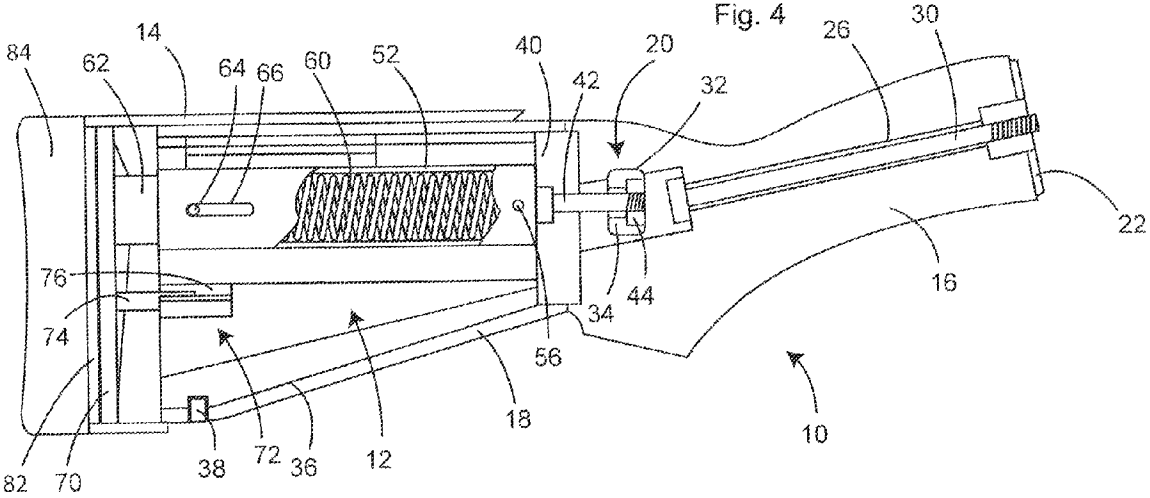
FIG. 4 is a partial sectional side view of the stock assembly in the non-recoil position.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Generally, a preferred embodiment of the invention as illustrated in the drawings is comprised of a stock, generally 10, a recoil reduction mechanism, generally 12, and a cheek rest, generally 14. Stock 10 is comprised of a front stock section 16 and a rear stock section 18. Stock sections 16 and 18 are releasibly attached by a stock section connector, generally 20.

Front stock section 16, generally shaped to be gripped by the user, includes a front face 22 shaped for attachment to the rear of a shotgun receiver 24. A bore 26 extends through section 16 to receive a rear inserted receiver connector bolt 30 used to attach section 16 to receiver 24. Section 16 also includes a transverse bore 32 to receive a stock connector 34.

Rear stock section 18 includes a rear-opening cavity 36 to receive recoil reduction mechanism 12. Mechanism 12 is held within cavity 36 by releasable set screw 38. Connector plate 40 is affixed across the front of stock section 18. A stock connector bolt 42 extends through plate 40 and screws into nut 44 on plug 34 to secure sections 16 and 18 together. The rear face of section 18 includes a recess to receive the front of connector plate 40.

Recoil reduction mechanism 12 is sized for insertion into cavity 36. Mechanism 12 is comprised of a housing 50, preferably molded of an appropriate plastic, with an integral cylindrical conduit 52 longitudinally aligned with stock 10. The front of conduit 52 is closed with conduit plug 54, attached to conduit 52 with pin 56. A compressible spring 60 is held within conduit 52, with the forward movement of spring 60 being prevented by plug 54.

A plunger 62 is slidably inserted into the rear of conduit 52, with the front face of plunger 62 abutting the rear of spring 60. Plunger 62 is held within conduit 52 by plunger pin 64 inserted transversely into the side of plunger 62 through longitudinal slot 66 in the wall of conduit 52. When mechanism 12 is in the non-recoil position, i.e., when the firearm is not being discharged, pin 64 is held against the rear of slot 66. However, when the firearm is being discharged, i.e., in the recoil position, plunger 62 moves further into conduit 52, with pin 64 moving toward the front end of slot 66.

A plunger plate 70 is affixed to the rear of plunger 62. Plate 70 has a rear face transverse to the longitudinal axis of conduit 52, and preferably has a cross-section the same as the cross-section of the rear face of rear stock section 18. An alignment guide 72 aids in maintaining alignment of plunger 62 within conduit 52 when pressure is applied to plate 70. Guide 72 is comprised of a longitudinally aligned guide bar 74 that extends forward from plate 70 and a slotted receiver 76 to receive bar 74.

Cheek rest 14 is comprised of a cheek plate 80 that extends over the top and at least part of one side of rear stock section 18. Plate 80 is configured to cover the sides of rear stock section 18 where a shooter's cheek would normally rest during shooting. Rest 14 also includes rest rear connector plate 82 mounted transverse to the longitudinal axis of conduit 52. The cross-section of plate 82 is preferably the same as the cross-section of plate 70. Plates 70 and 82 are releasibly attached. e.g., by screws, not shown. Butt plate 84 is attached to the rear face of plate 82.

The stock assembly is assembled by bolting front face 22 of front section 16 to receiver 24 with bolt 30. Connector 34 is inserted into bore 32 after section 16 is bolted to receiver 24. The front of rear stock section 18 is then placed against the rear of front section 16 and sections 16 and 18 are bolted together with bolt 42, which is inserted through plate 40 and screwed into nut 44 on connector 34 inserted into bore 32. Bolts 30 and 42 are normally at an angle to each other. Recoil reduction mechanism 12 is then inserted into cavity 36 in stock section 18 and secured in place with set screw 38. Cheek rest 14 is then positioned over stock section 18 and joined to mechanism 12 by releasibly attaching cheek connector plate 82 to plunger plate 70. Butt plate 84 is then attached to the rear face of plate 82.

Figure 6:
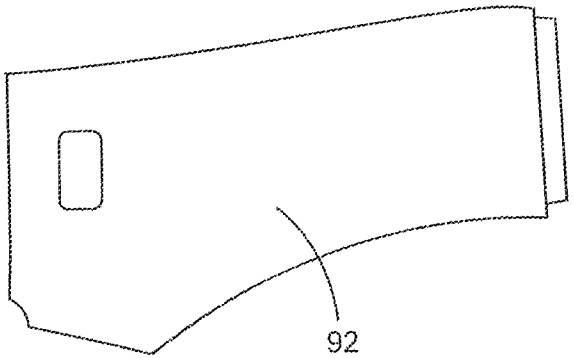
FIGS. 5 and 6 are side views of other front stock sections for attachment to different styles of firearms that have different rear face profiles.
Figure 5:
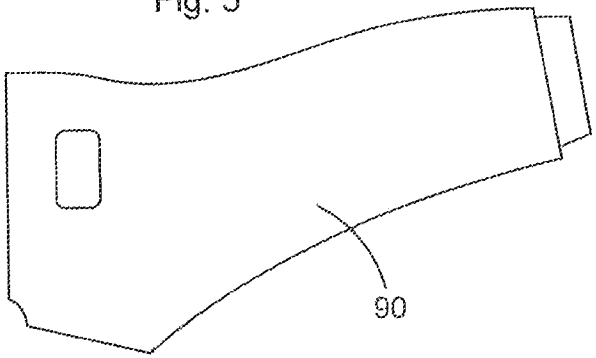

Instead of front stock section 16, rear stock section 18 may be attached to different front stock sections such as front stock sections 90 and 92 shown for example in FIGS. 5 and 6, respectively. It will be understood that the invention is not limited to any particular front stock section configuration, the only requirement being that the front stock sections have the same rear face configuration for attachment to the front face of the same common rear stock section. The invention also contemplates a kit comprised of one rear stock section, a recoil reduction mechanism, and a plurality of different front stock sections attachable to the rear stock section.

When the firearm is to be used, the shooter grips the firearm in the normal manner and places his or her cheek against a side of cheek rest 14 with butt plate 84 against his or her shoulder. When the firearm is discharged, the recoil urges stock 10 rearwardly. Since plunger plate 70 is prevented from rearward movement by the shooter's shoulder, plunger 62 moves into conduit 52 compressing spring 60 to absorb a part of the recoil. As the recoil dissipates, the force of spring 60 returns plunger 62 to its original position. During firing, the shooter's cheek remains firmly against cheek plate 80 so that no pinching occurs and the stock is held steady.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A recoil reduction stock assembly for a shoulder-fired firearm, said stock assembly comprising:

a) a front stock section having a rear face, a front face adapted for attachment to the rear face of a firearm receiver, a transverse bore and a stock connector bore extending from said front stock section rear face to said transverse bore;

b) a rear stock section having a rear-opening recoil reduction mechanism cavity, a front wall, and a front face adapted for attachment to said front stock section rear face;

c) a stock section connector including a connector plug inserted into said transverse bore and a stock connector bolt with a threaded end extending forward through said rear stock section front wall and connector bore into attachment to said connector plug for attaching said front and rear stock sections, said connector plug includes a threaded nut to receive the threaded end of said stock connector bolt;

d) a receiver connector to attach said front stock section to a firearm receiver; and e) a recoil reduction mechanism inserted into the rear stock section cavity.

2. The recoil reduction stock assembly of claim 1, further including a cheek rest slidable over said rear stock section and attached to said recoil reduction mechanism.

3. The recoil reduction stock assembly of claim 1, wherein said recoil reduction mechanism includes a longitudinally aligned cylinder, a compressible spring within said cylinder, and a plunger extending from the rear of said cylinder, said plunger having a forward end against said spring, whereby recoil of said firearm compresses said spring against said plunger to absorb recoil.

4. The recoil reduction stock assembly of claim 1, wherein said front stock section includes a receiver connector bore extending rearwardly from the front face of said front stock section, and said receiver connector includes a bolt extending through said receiver connector bore for connection with said receiver.

5. A recoil reduction stock assembly for a shoulder-fired firearm, said stock assembly comprising:

a) a front stock section having a rear face, a front face adapted for attachment to the rear face of a firearm receiver, a transverse bore, a stock connector bore extending from said front stock section rear face to said transverse bore, and a receiver connector extending bore from the front stock section front face;

b) a rear stock section having a rear-opening recoil reduction mechanism cavity, a front wall, and a front face adapted for attachment to said front stock section rear face;

c) a stock section connector including a connector plug inserted into said transverse bore and a stock connector bolt with a threaded end extending forward through said rear stock section front wall and stock connector bore into attachment to said connector plug for attaching said front and rear stock sections, said connector plug includes a threaded nut to receive the threaded end of said stock connector bolt;

d) a receiver connector bolt extending through said receiver connector bore to attach said front stock section to a firearm receiver; and e) a recoil reduction mechanism inserted into the rear stock section cavity.

6. The recoil reduction stock assembly of claim 5, further including a cheek rest slidable over said rear stock section and attached to said recoil reduction mechanism.

7. The recoil reduction stock assembly of claim 5, wherein said recoil reduction mechanism includes a longitudinally aligned cylinder, a compressible spring within said cylinder, and a plunger extending from the rear of said cylinder, said plunger having a forward end against said spring, whereby recoil of said firearm compresses said spring against said plunger to absorb recoil.

8. A recoil reduction stock assembly for a shoulder-fired firearm, said stock assembly comprising:

a) a front stock section having a rear face, a front face adapted for attachment to the rear of a firearm receiver, a longitudinal receiver bolt bore extending from the front face to the rear face of said front stock section, and a stock section connector bore extending transversely into said front stock section;

b) a rear stock section having a rear-opening recoil reduction mechanism cavity, and a front connector wall with a longitudinal bore;

c) a stock section connector plug insertable into said front stock section connector bore;

d) a receiver connector bolt insertable through said front stock section bolt bore to attach said front stock section to a firearm receiver;

e) a stock connector bolt extending through said rear stock section front wall and into attachment with said connector plug to attach said rear stock section to said front stock section; and f) a recoil reduction mechanism inserted into the rear stock section cavity, said recoil reduction mechanism including a longitudinally aligned cylinder, a compressible spring within said cylinder, and a plunger extending from the rear of said cylinder, said plunger having a forward end against said spring, whereby recoil of said firearm compresses said spring against said plunger to absorb recoil.

9. The recoil reduction stock assembly of claim 8, further including a cheek rest having a rear plate transverse to the longitudinal axis of said rear stock section and said recoil reduction mechanism includes a plunger, said cheek rest rear plate being releasibly attached to said plunger.

10. The recoil reduction stock assembly of claim 8, wherein said stock connector bolt has a threaded end and said connector plug includes a threaded nut to receive the threaded end of said connector bolt.

11. The recoil reduction stock assembly of claim 8, wherein said receiver connector bolt is at an angle to said stock connector bolt.

12. A recoil reduction stock system for a shoulder-fired firearm, said stock system comprising:

a) a first front stock section having a rear face, a front face adapted for attachment to the rear face of a first firearm receiver, a transverse bore and a stock connector bore extending from said first front stock section rear face to said transverse bore;

b) a second front stock section having a rear face, a front face different from the front face of said first stock section adapted for attachment to the rear face of a second firearm receiver having a rear face different from the rear face of said first receiver, a transverse bore and a stock connector bore extending from said second front stock section rear face to said of said second front stock section transverse bore;

c) a rear stock section having a rear-opening recoil reduction mechanism cavity, a front wall, and a front face adapted for interchangeable attachment to the rear face of said first front stock section and the rear face of said second front stock section;

d) a stock section connector including a connector plug interchangeably inserted into either of said transverse bores and a stock connector bolt with a threaded end extending forward through said rear stock section front wall and a corresponding one of the stock connector bores into attachment with said connector plug for interchangeably attaching either of said front stock sections to said rear stock section, said connector plug includes a threaded nut to receive the threaded end of said stock connector bolt;

e) a receiver connector to attach either one of said front stock sections to a firearm receiver; and f) a recoil reduction mechanism inserted into the rear stock section cavity.

13. The recoil reduction stock assembly of claim 12, further including a cheek rest slidable over said rear stock section and attached to said recoil reduction mechanism.

14. The recoil reduction stock assembly of claim 12, wherein said recoil reduction mechanism includes a longitudinally aligned cylinder, a compressible spring within said cylinder, and a plunger extending from the rear of said cylinder, said plunger having a forward end against said spring, whereby recoil of said firearm compresses said spring against said plunger to absorb recoil.

15. The recoil reduction stock assembly of claim 12, wherein each of said front stock sections includes a receiver connector bore extending rearwardly from the front face of each front stock section, and said receiver connector includes a receiver connector bolt extending through either of the receiver connector bores for connection with said receiver.

16. The recoil reduction stock assembly of claim 15, wherein said receiver connector bolt is at an angle to said stock connector bolt.

* * * * *